US007806124B2

(12) United States Patent
Mackinder

(10) Patent No.: US 7,806,124 B2
(45) **Date of Patent: *Oct. 5, 2010**

(54) HEATABLE HAIR CURLER

(76) Inventor: Vivienne J. Mackinder, 65 Topping Dr., Riverhead, NY (US) 11901

( * ) Notice: Subject to any disclaimer, the term of this patent is extended or adjusted under 35 U.S.C. 154(b) by 752 days.

This patent is subject to a terminal disclaimer.

(21) Appl. No.: 11/221,224

(22) Filed: Sep. 7, 2005

(65) Prior Publication Data

US 2006/0005852 A1 Jan. 12, 2006

Related U.S. Application Data

(62) Division of application No. 10/458,757, filed on Jun. 10, 2003, now Pat. No. 7,017,590.

(51) Int. Cl.
*A45D 2/00* (2006.01)
*A45D 1/20* (2006.01)
*A45D 4/16* (2006.01)

(52) U.S. Cl. ..... 132/233; 132/222

(58) Field of Classification Search ..... 132/247, 132/212, 220, 222, 223, 227, 233, 251, 262, 132/264

See application file for complete search history.

(56) References Cited

U.S. PATENT DOCUMENTS

| | | | | |
|---|---|---|---|---|
| 2,137,511 | A | 11/1938 | Sierad | |
| 3,822,705 | A | 7/1974 | Pilotte | |
| 3,900,035 | A | 8/1975 | Welch et al. | |
| 3,902,508 | A | 9/1975 | Sliman, Sr. | |
| 4,164,951 | A * | 8/1979 | Shaler et al. | 132/233 |
| 4,592,358 | A | 6/1986 | Westplate | |
| 4,676,247 | A | 6/1987 | Van Cleve | |
| 5,025,816 | A | 6/1991 | Jones | |
| 5,065,758 | A | 11/1991 | Whitehead et al. | |
| 5,411,040 | A | 5/1995 | Forrest | |
| 5,480,418 | A | 1/1996 | Zeoli-Jones | |
| 5,628,070 | A * | 5/1997 | Kefelian | 2/174 |
| 5,665,057 | A | 9/1997 | Murphy | |
| 5,676,871 | A | 10/1997 | Graves | |
| 5,694,955 | A | 12/1997 | Grooms | |
| 5,716,388 | A | 2/1998 | Petelle | |
| 5,771,907 | A | 6/1998 | Dickson | |
| 5,819,763 | A | 10/1998 | Hallowell, II | |
| 5,988,182 | A | 11/1999 | Engelbrecht | |

(Continued)

OTHER PUBLICATIONS

Article, http://www.remington-products.com/usa/products/haircare/hotrollers.html, Remington Products, Hot Rollers, For curls that set trends, pp. 1-2.

(Continued)

*Primary Examiner*—Robyn Doan
(74) *Attorney, Agent, or Firm*—Kinney & Lange, P.A.

(57) ABSTRACT

A heatable hair curler includes an elongate casing, an interior cavity, and a heat absorbent material. The elongate casing is made of a flexible material and has an axial length of at least about 7.5 inches and a width of at least about 1.25 inches. The casing has opposite first and second ends that are attachable to each other. The interior cavity is located between the first and second ends and is separated from the first and second ends by first and second seams, respectively. The heat absorbent material substantially fills the cavity.

21 Claims, 6 Drawing Sheets

U.S. PATENT DOCUMENTS

| | | | |
|---|---|---|---|
| 6,064,051 | A | 5/2000 | Gray |
| 6,068,122 | A | 5/2000 | Burns et al. |
| 6,079,422 | A | 6/2000 | Drago et al. |
| 6,352,080 | B1 | 3/2002 | Neville |
| 6,537,308 | B2 | 3/2003 | Burkhart |
| 6,631,725 | B2 | 10/2003 | Gray |
| 7,334,585 | B2 * | 2/2008 | Anzevino ..... 132/247 |

OTHER PUBLICATIONS

Article, http://www.remington-products.com/usa/products/haircaire/h2032.html, Remington Products, Hot Rollers, Rag Rollers, p. 1.

* cited by examiner

HEATABLE HAIR CURLER

CROSS-REFERENCE TO RELATED APPLICATION(S)

This application is related to and a divisional of the application Ser. No. 10/458,757, filed on Jun. 10, 2003, entitled "Microwavable Hair Curling Device" and related to application Ser. No. 11/121,788, filed on May 5, 2004, entitled "Hair Curling Device", which are herein incorporated by reference.

BACKGROUND OF THE INVENTION

The present invention relates to a hair curling device. In particular, the present invention relates to a heatable hair curling device that is effective, yet easy, safe, and time-efficient to use.

Numerous hair curling devices have been introduced over the years. Hair curling devices come in a variety of configurations, sizes, and materials. It is well known that the most efficient way to curl hair is with thermal energy. Hair can be curled in the absence of heat if the hair is wrapped around the curling device when it is wet and allowed to dry into a curl. However, waiting for hair to air dry takes a long time, making it inconvenient in today's fast paced world. In addition, rollers can be uncomfortable to wear, especially for long periods of time while waiting for hair to dry.

Most of the prior art hair curling devices employ an electrical heating means. A curling iron, while effective at curling hair quickly, gets extremely hot and can burn the hair and blister the skin, making it dangerous for the elderly and the young to use. In addition, a curling iron takes a long time to heat, possibly exposes the user to electric shock, and limits the user's movement to the range of the electric cord. Hot rollers, while they do not readily burn the skin or limit movement, are very hot to the touch and therefore hard to handle. In addition, hot rollers are heavy and have a tendency to fall out of the hair.

Microwave energy has also been used as a means for heating hair curling devices. U.S. Pat. Nos. 6,064,051, 6,079,422, 5,988,182, and 6,352,080 provide curlers which may be heated directly in the microwave. The known curlers contain a microwave heatable material which transfers energy from the curler to the hair, causing the hair to curl. The curlers hold the hair in place with pins, clips, ties, surface protrusions, or combs. In these cases, individual curlers are heated one at a time, immediately before being placed in the hair. If not placed immediately in the hair after being heated, the heat will dissipate from the curlers into the atmosphere. Also, the process of clipping, tying, or pinning the curler in place is cumbersome if being done by one person. This makes the process of heating and setting hair especially time consuming. Another problem with prior art microwavable hair curlers is that they can be easily lost or misplaced.

It is well known in the art of cosmetology that curling hair at higher temperatures results in longer lasting curls. Unfortunately, heat is also known in the art to dry hair out, eventually causing split ends and breakages. In addition, heat can be dangerous to the skin. Thus, there continues to be a need for a hair curling device whose use of heat does not dry out the hair, is warm (not hot) to the touch, is capable of withstanding high temperatures without melting or scorching, and is simple to wrap hair around and hold in place. The cylindrical roller shape of most prior art curlers gives the hair rigid, symmetrical, and ultimately unnatural looking curls. None of the prior art hair curling devices have been satisfactory. Thus, there exists a need for a hair curling system which is effective at curling, gentle on the hair, easy, safe, time-efficient, and capable of producing relaxed and natural looking curls.

BRIEF SUMMARY OF THE INVENTION

The present invention includes a heatable hair curler comprising an elongate casing, an interior cavity, and a heat absorbent material. The elongate casing is made of a flexible material and has an axial length of at least about 7.5 inches and a width of at least about 1.25 inches. The casing has opposite first and second ends that are attachable to each other. The interior cavity is located between the first and second ends and is separated from the first and second ends by first and second seams, respectively. The heat absorbent material substantially fills the cavity.

DETAILED DESCRIPTION

Figure 1:
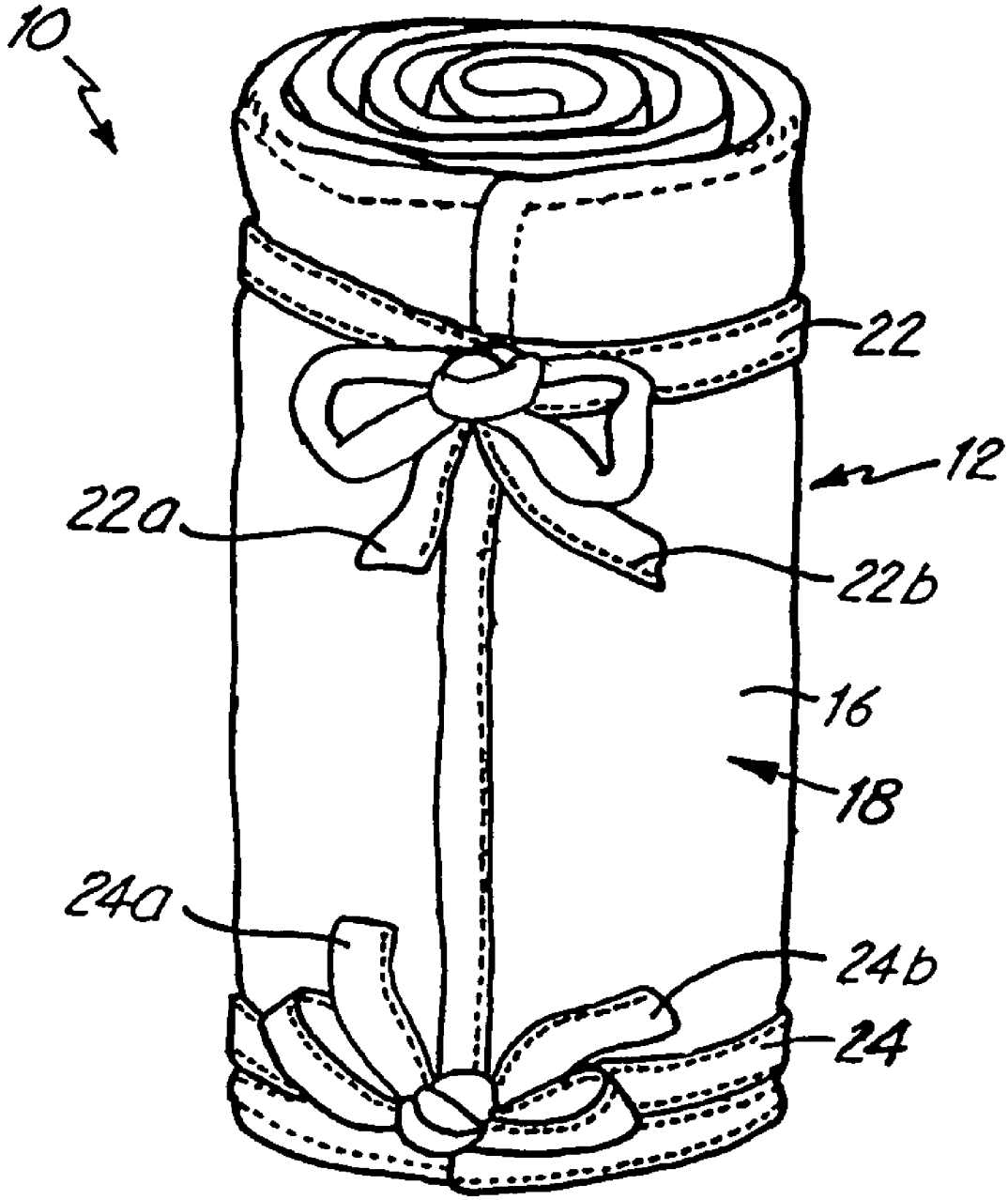
FIG. 1 is a perspective view of the hair curling device.

FIG. 1 is a perspective view of a hair curling device 10. Hair curling device 10 consists of a carrier 12 and a set of hair curlers 14 (shown in detail in FIG. 2). Carrier 12 includes a thermal insulating blanket 16 which, as shown in FIG. 1, may be rolled into a cylindrical shape. Blanket 16 has an exterior surface 18 and an interior surface 20 (shown in detail in FIG. 2) made of fire retardant fabric. Straps 22 and 24 are attached on exterior surface 18 of blanket 16. Free ends 22*a* and 22*b* of strap 22 are tied together and free ends 24*a* and 24*b* of strap 24 are tied together to hold carrier 12 in its fully rolled cylindrical shape. Devices other than straps 22 and 24 can be used to hold carrier 12 in its cylindrical shape so long as the device is fire retardant. Other embodiments of carrier 12 can be used as well. For example, blanket 16 may be simply folded so that it forms a flat carrier instead of a cylinder.

Surfaces 18 and 20 and straps 22 and 24 of blanket 16 are made of a fire-retardant fabric that is lightweight, flexible, machine washable and capable of withstanding temperatures of at least about 250° F. without scorching or melting. Preferably, blanket 16 is made out of fabrics with fire-retardant properties such as NOMEX®, NOVEON®, MILLENIA™, KOTHMEX™ or KYNOL™ brand materials. Blanket 16 preferably is capable of withstanding temperatures of at least about 600° F.

Figure 2:
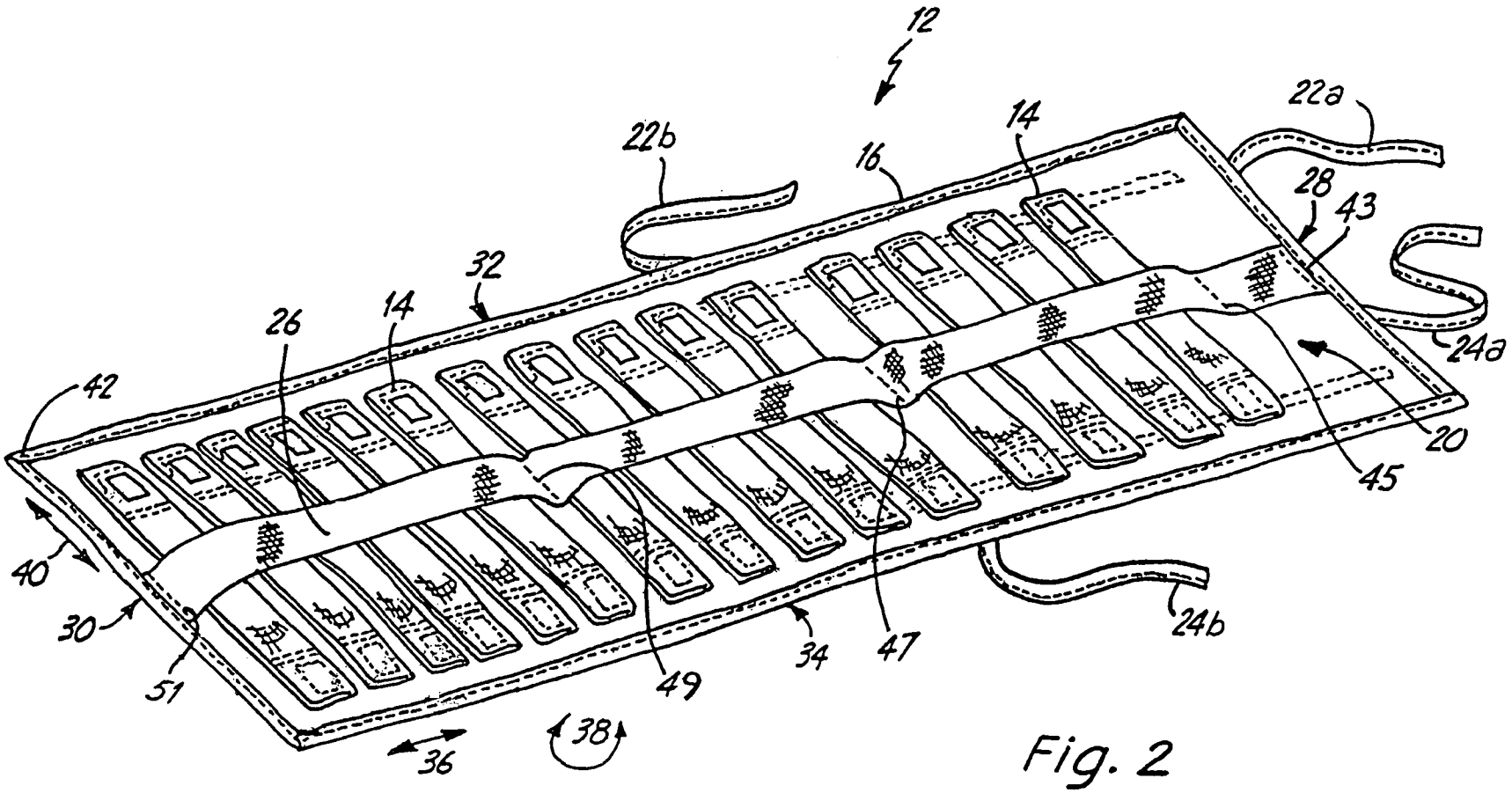
FIG. 2 is a perspective view of a carrier in a fully unrolled configuration exposing a set of hair curlers.

FIG. 2 shows carrier 12 after thermal blanket 16 is fully unrolled. When blanket 16 is fully unrolled, carrier 12 reveals interior surface 20, center strap 26, and set of hair curlers 14. Center strap 26 runs lengthwise down interior surface 20 of blanket 16. Hair curlers 14 are held in place under center strap 26. Curlers 14 will be discussed in more detail with reference to FIGS. 3A and 3B.

Interior surface 20 of blanket 16 is rectangular in shape having the following features: opposite first and second ends 28 and 30, opposite first and second side edges 32 and 34, length 36, roll axis 38, width 40, and seam 42. To reveal interior surface 20, blanket 16 is unrolled from first end 28 to second end 30 about roll axis 38. When fully unrolled, interior surface 20 is about twenty-nine inches long along length 36. Interior surface 20 is about eight inches wide along width 40 when measured between side edges 32 and 34. First and second ends 28 and 30 run transverse to side edges 32 and 34. Interior surface 20 and exterior surface 18 (see FIG. 1) are stitched together at seam 42.

Center strap 26 is attached to interior surface 20 of blanket 16 at the following five attachment points: 43,45,47,49, and 51; however, different embodiments of the present invention may differ in the number of attachment points, so long as at least one curler 14 is able to fit in between them. In FIG. 2, fifteen hair curlers 14 are secured under center strap 26 in between the aforementioned attachment points 43,45,47,49, and 51. When placed under strap 26, curlers 14 are lined up side-by-side so that they are parallel to first and second ends 28 and 30 of interior surface 20. Center strap 26 is preferably made of the same fire-retardant material as blanket 16. The fabric is lightweight, flexible, machine washable and capable of withstanding temperatures of at least about 250° F. Preferably, center strap 26 is made out of fabrics with fire retardant properties such as NOMEX®, NOVEON®, MILLENIA™, KOTHMEX™ or KYNOL™ brand materials. Hair curlers 14 may be held in place by devices other than center strap 26 so long as the device is fire-retardant, flexible, machine washable, and capable of holding curlers 14 side-by-side along interior surface 20.

Attachment points 43,45,47,49, and 51 of center strap 26 keep curlers 14 organized so that thermal blanket 16 may be easily rolled into a cylindrical shape without curlers 14 falling out and becoming lost or misplaced. Carrier 12, complete with interior and exterior surfaces 20 and 18 of thermal blanket 16, center strap 26, and exterior straps 22 and 24, is designed to be fire-retardant, lightweight and machine washable. In addition, thermal blanket 16 is easy to roll and unroll, safe to use, easy to transport and an excellent place to store curlers in between uses.

Figure 3A:
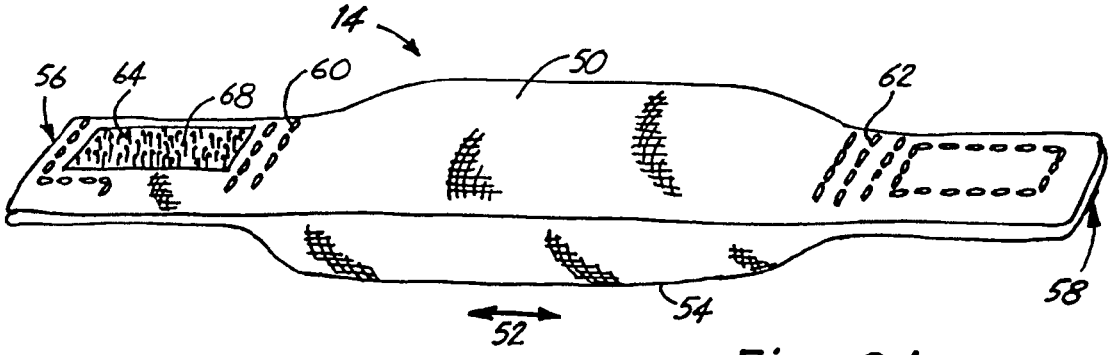
FIG. 3A is a side view of one embodiment of a hair curler of the present invention.

FIG. 3A shows one embodiment of hair curler 14. Hair curler 14 comprises the following features: outer casing 50, axial curler length 52, body 54, opposite first and second ends 56 and 58, first and second seams 60 and 62, first fastener 64, and second fastener 66 (shown in detail in FIG. 3B). Hair curler 14 is shaped like a rod and is about 7.5 inches long when measured along axial length 52 and is about 1.25 inches wide. Both first end 56 and second end 58 are flat in order to accommodate the placement of first and second fasteners 64 and 66. First and second ends 56 and 58 each measure about 2.25 inches long and 1.25 inches wide. Body 54 of curler 14 is not flat and has a total circumference of about 2.5 inches when measured around its center. First and second seams 60 and 62 separate body 54 of curler 14 from flat ends 56 and 58. Body 54 of curler 14 measures about 3.5 inches along axial curler length 52 between first and second seams 60 and 62. Outer casing 50 of hair curler 14 is made out of fire-retardant fabric that is lightweight, flexible, machine washable, and capable of withstanding temperatures of at least about 250° F. Preferably, outer casing 50 is made out of fabric with fire-retardant properties such as NOMEX®, NOVEON®, MILLENIA™, KOTHMEX™ or KYNOL™ brand materials.

Fasteners 64 and 66 are preferably made of hook and loop material, capable of withstanding temperatures of at least about 250° F. First fastener 64 is disposed on the top of first end 56 while second fastener 66 is disposed on the bottom of second end 58. First fastener 64 is preferably composed of tiny loops 68 while second fastener 66 is composed of tiny hooks 70. Seams 60 and 62 protect ends 56 and 58 of curler 14 from getting too hot and damaging fasteners 64 and 66. The hook and loop fastening device used in this embodiment may be replaced by other machine washable, fire-retardant fastening devices so long as both ends 56 and 58 of curler 14 are capable of fastening together and the fastener does not melt or scorch under heat.

Figure 3B:
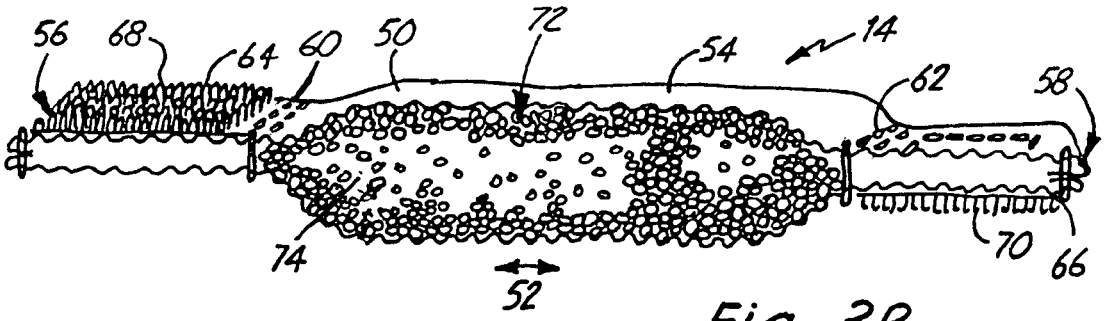
FIG. 3B is a perspective view of a section of the hair curler of FIG. 3A of the present invention.

FIG. 3B is a perspective view of a section of hair curler 14 of FIG. 3A. The cross-section of hair curler 14 shows the following components: outer casing 50, axial curler length 52, body 54, first and second ends 56 and 58, first and second seams 60 and 62, first and second fasteners 64 and 66, interior cavity 72, and heat absorbent material 74. Outer casing 50 is the outermost layer of curler 14 and covers entire curler 14. Interior cavity 72 forms the inside of body 54. Interior cavity 72 is filled with heat absorbent material 74, preferably in the form of silica beads or other desiccant material.

Heat absorbent material 74 fills interior cavity 72 of hair curler 14. Heat absorbent material 74 includes, but is not limited to, silica beads, buckwheat, flax seed, thermal gel, and any other desiccant material capable of releasing moisture when heated. In one embodiment, heat absorbent material 74 is in the form of silica beads, specifically 99.5% $SiO_2$; 0.021% $Na_2O$; 0.02% $Fe_2O_3$; 0.01% MgO; 0.04% Ca; 0.16% $A_{12}O_3$, and 0.01% other compounds (all percentages given are weight percentages). The grain size of each silica bead can vary from about 0.5 millimeters to 5.0 millimeters in diameter.

Silica beads are preferably used as heat absorbent material 74 because as a desiccant they adsorb moisture at room temperature and release moisture upon being heated to temperatures of approximately 250° F. to 350° F. When using the preferred embodiment of the present invention, post-heated silica beads release moisture and heat through outer casing 50 of hair curler 14 into the hair shaft. Thus, hair curler 14, when used according to the present invention, both moisturizes and curls hair at the same time. Once the hair cools, which takes about five minutes, the curls are set and the curlers may be removed.

Hygiene is important in personal care, especially if several people in a family are using the same styling tool. Styling products, such as hair spray and gel, can build up on hair curling tools. The build-up of old styling product on hair curling tools is unhygienic and not good for styling performance reasons. Fire-retardant fabric and silica, as used in the present invention, are machine washable and make curling hair with the present invention more sanitary than conventional methods. In addition, fabric is gentle on the hair, unlike bristles, plastic, and metal styling tools. Because outer casing 50 of curler 14 is made of soft fabric and the shape of curler 14 is not cylindrical, each curl produced by the present invention is unique—unlike curls produced by roller cylinders of consistent form and uniform shape.

Figure 4:
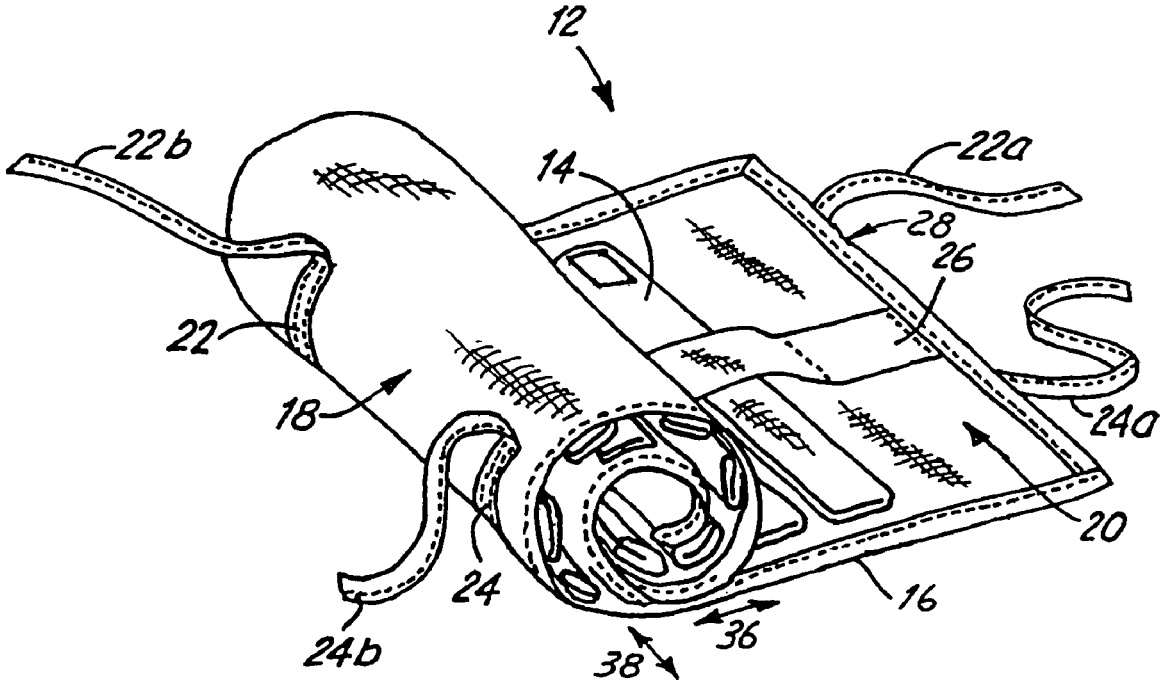
FIG. 4 is a perspective view showing the carrier in a partially unrolled configuration.

To use hair curling device 10, carrier 12 is heated in its fully rolled configuration (as shown in FIG. 1). Once heated to a temperature capable of curling human hair, fully rolled carrier 12 is untied and unrolled to expose one curler 14 at a time. FIG. 4 is a perspective view of carrier 12 being used according to the present invention. FIG. 4 shows the following features: thermal blanket 16, strap 22 and its free ends 22*a* and 22*b*, strap 24 and its free ends 24*a* and 24*b*, exterior surface 18, interior surface 20, center strap 26, first end 28, length 36, roll axis 38, and curlers 14. Once carrier 12 is heated, free strands 22*a* and 22*b* and 24*a* and 24*b* are untied. Carrier 12 is then opened by unrolling thermal blanket 16 from first end 28 to second end 30 (shown in FIG. 2) down its length 36. Carrier 12 is preferably unrolled slowly so that only one curler 14 is exposed at a time. FIG. 4 is an example of how carrier 12 is unrolled to reveal just one curler 14 at a time. FIG. 4 shows one curler 14 held in place against interior surface 20 under center strap 26. Remaining curlers 14 remain wrapped inside the rolled portion of carrier 12 where they stay warm while awaiting use.

Figure 5:
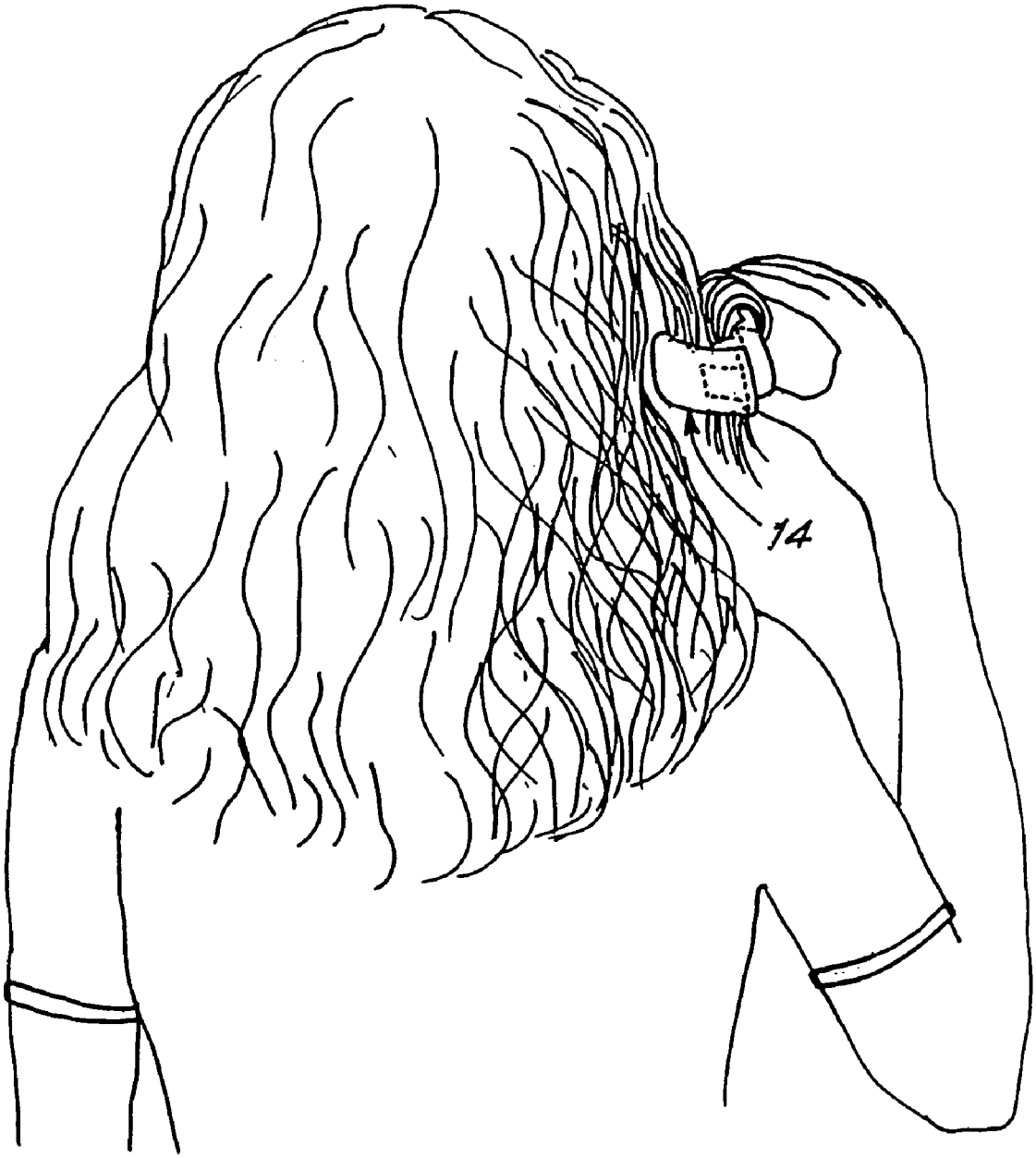
FIG. 5 is a rear view of a hair curler of the present invention placed in a section of hair.
Figure 6A:
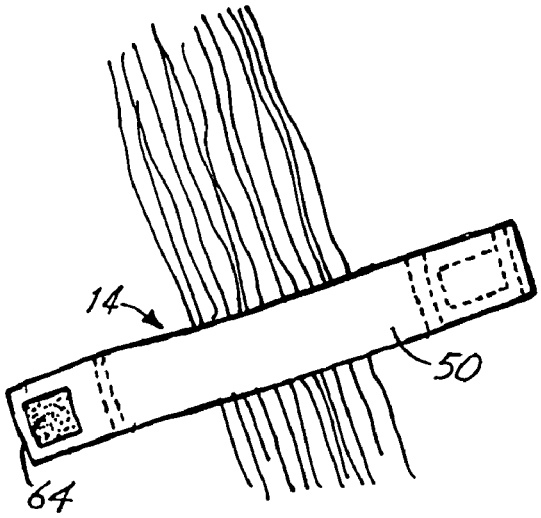
FIG. 6A shows the hair curler of the present invention placed near the end of a section of hair to be curled.
Figure 6B:
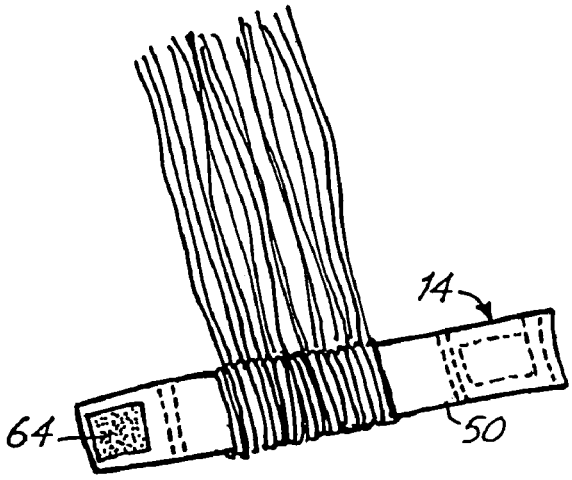
FIG. 6B shows the section of hair being wrapped around the hair curler of FIG. 6A of the present invention.
Figure 6C:
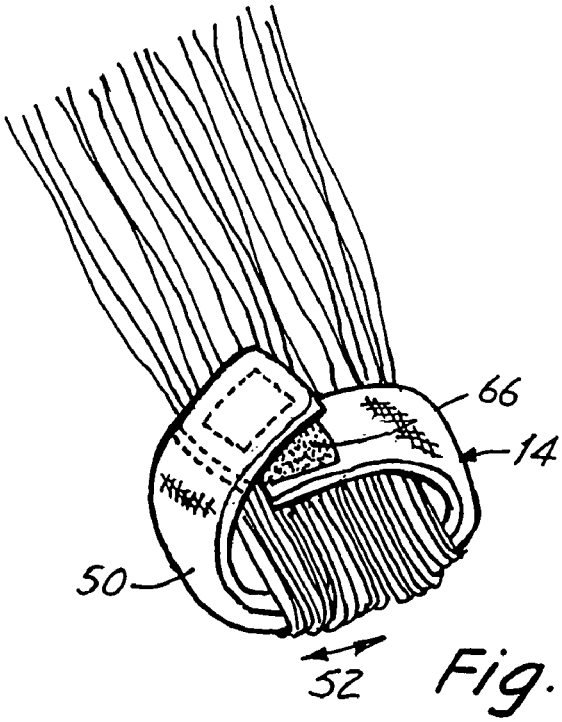
FIG. 6C shows the ends of the hair curler fastened together after the section of hair has been fully wrapped around the hair curler of the present invention.

To use the present invention, human hair is first divided into sections that the user wishes to curl. Immediately after exposing a warm curler 14 as shown in FIG. 4, curler 14 is removed from carrier 12 and placed in the section of hair the user wishes to curl, as shown in FIG. 5. FIGS. 6A through 6C show the steps involved in using the present invention after a warm curler 14 has been removed from carrier 12. FIG. 6A shows curler 14 placed at the end of a section of hair that a user wishes to curl. FIG. 6B shows wrapping a section of hair around outer casing 50 of curler 14. Hair may be wrapped either over or under curler 14, depending on the desired curl. Once a section of hair is fully wrapped around curler 14, curler 14 is fastened together to hold the curl in place. FIG. 6C shows a rear view of a user securing curler 14 in place by bending curler 14 along its axial length 52 and attaching first fastener 64 (shown in FIG. 6A) to second fastener 66. Because hair is wound multiple times around hair curler 14 (see FIG. 6B and FIG. 6C), curler 14 will not fall out. Curler 14 is lightweight and easy to fasten in place. For each additional section of hair a user wishes to curl, another warm curler 14 is removed from carrier 12 while remaining curlers 14 stay warm inside carrier 12. The steps shown in FIG. 6A through FIG. 6C are repeated for each additional hair section. Once the wrapped hair cools (approximately 5 minutes), curlers 14 are removed, leaving a natural wavy curl that is easy to style.

The present invention provides a fast, safe, clean, and easy way to curl hair. Whereas previous hair curling devices were effective at curling hair, their intense heat dried out the user's hair and posed a risk of burning the user's skin. In addition, devices heated with electrical heat put the user at risk of electrical shock and limited the user's movement to the range of the electric cord. The present invention solves these problems by providing a hair curling device whose use of heat does not dry out the hair, is warm (not hot) to the touch, and is simple to wrap hair around and hold in place. In addition, the carrier of the present invention solves the cumbersome and time-consuming process of having to heat individual curlers one at a time. The carrier allows all curlers to be heated together in one easy step, and prevents the curlers from losing heat. The carrier also provides a place to store curlers between uses so that the curlers are not lost or misplaced.

Although the present invention has been described with reference to preferred embodiments, workers skilled in the art will recognize that changes may be made in form and detail without departing from the spirit and scope of the invention.

The invention claimed is:

1. A heatable hair curler comprising:

an elongate casing of flexible material having an axial length of at least about 7.5 inches and a width of at least about 1.25 inches, the casing having a first flat end portion, a second flat end portion opposite the first flat end portion, and a center portion located between the first and second flat end portions, the first and second flat end portions being attachable to each other, the flexible material consisting essentially of a fire-retardant fabric capable of withstanding temperatures of at least about 250° F.;

an interior cavity defined by the center portion, a first end of the center portion bounded from the first flat end portion by a first seam and a second end of the interior cavity bounded from the second flat end portion by a second seam; and silica beads of at least about 0.05 millimeters in diameter filling the cavity from the first end to the second end of the center portion, the silica beads being retained in the center portion by the first and the second seams.

2. The heatable hair curler of claim 1, wherein the fire retardant fabric is capable of withstanding temperatures of at least about 600° F.

3. The heatable hair curler of claim 1, wherein the silica beads absorb moisture at room temperature and expel moisture when heated to approximately 250-350° F.

4. The heatable hair curler of claim 1, and further comprising a fastener for attaching the first flat end portion of the elongate casing to the second flat end portion of the elongate casing.

5. A hair curler for curling human hair, the hair curler comprising:

a flexible, rod-shaped housing made of a fire-retardant material capable of being heated to at least about 600° F. the housing having an axial length of at least of about 7.5 inches and a width of at least about 1.25 inches, the housing having a first flat end portion and a second flat end portion, the first and second flat end portions being attachable to each other;

a center body portion located between the first and second flat end portions of the housing and formed from the fire-retardant material, the center body portion having a circumference of about 2.5 inches, the center body portion having a first end bounded from the first flat end portion by a first seam and a second end bounded from the second flat end portion by a second seam; and a heat absorbent material filling the center body portion from the first end to the second end, the heat absorbent material being retained in the center body portion by the first and the second seams, the heat absorbent material absorbs moisture at room temperature and expels moisture when heated to approximately 250-350° F., wherein the heat absorbent material is silicia in the form of beads of at least about 0.05 millimeters in diameter.

6. The hair curler of claim 5, wherein the first flat end portion and the second flat end portion are each about 2.25 inches long and about 1.25 inches wide.

7. The hair curler of claim 5, wherein the center body portion is about 3.5 inches long.

8. A hair curler capable of retaining heat, the hair curler comprising:

an elongate casing of flexible fire-retardant material having an axial length of at least about 7.5 inches and a width of at least about 1.25 inches, the casing having a first flat end portion, a second flat end portion opposite the first flat end portion, and a center portion between the first and second flat end portions, the center portion having a first end bounded from the first flat end portion by a first seam and a second end bounded from the second flat end portion by a second seam;

a fastener for attaching the first flat end portion and the second flat end portion to each other;

an interior cavity bounded by the fire-retardant material of the center portion and the first and second seams; and silica beads of at least about 0.05 millimeters in diameter filling the cavity, the silica beads retained in the center portion by the first and the second seams, the silica beads absorb moisture at room temperature and expel moisture when heated to a temperature above room temperature.

9. The hair curler of claim 8, wherein the fastener is a hook and loop fastener comprising a hook portion and a loop portion.

10. The hair curler of claim 9, wherein the hook portion is disposed on the first flat end portion of the casing and the loop portion is disposed on the second flat end portion of the casing.

11. The hair curler of claim 8, wherein the fastener is capable of withstanding temperatures of at least about 250° F.

12. A hair curling device comprising:

a flexible, elongate casing formed of a fire retardant fabric capable of withstanding temperatures of at least about 600° F., the casing having an axial length of at least of about 7.5 inches and a width of at least about 1.25 inches, the casing having a substantially flat first end portion and a substantially flat second end portion, wherein the first and second flat end portions are attachable to each other;

a center portion positioned between the first and second flat end portions and formed from the fire retardant fabric, the center portion having a first end bounded from the first flat end portion by a first seam and a second end bounded from the second end portion by a second seam; and a desiccant material filling the center portion from the first end to the second end, the desiccant material being retained in the center portion by the first and the second seams wherein the desiccant material is silica in the form of beads of at least about 0.05 millimeters in diameter.

13. The hair curling device of claim 12, wherein the desiccant material absorbs moisture at a first temperature and expels moisture when heated to a second, higher temperature.

14. The hair curler of claim 13, wherein the desiccant material absorbs moisture at room temperature and expels moisture when heated to a temperature above room temperature.

15. The hair curling device of claim 12, and further comprising a fastener for attaching the first flat end portion of the flexible, elongate casing to the second flat end portion of the flexible, elongate casing.

16. A heatable hair curler comprising:

an elongate casing of flexible fire-retardant material having an axial length of at least about 7.5 inches and a width of at least about 1.25 inches, the casing having a first flat end portion, a second flat end portion opposite the first flat end portion, and a center portion located between the first and second flat end portions, the first and second flat end portions being attachable to each other;

an interior cavity defined by the center portion, the interior cavity having a first end bounded from the first flat end portion by a first seam and a second end bounded from the second flat end portion by a second seam; and silica beads having diameters of about 0.05 millimeters filling the cavity from the first end to the second end of the center portion, the silica beads being retained in the center portion by the first and the second seams, wherein the silica beads absorb moisture at room temperature and expel moisture when heated to a temperature above room temperature.

17. The heatable hair curler of claim 16, wherein the elongate casing is formed of a material capable of withstanding temperatures of at least about 250° F.

18. The heatable hair curler of claim 17, wherein the elongate casing is formed of a fire retardant fabric capable of withstanding temperatures of at least about 600° F.

19. A hair curler for curling human hair, the hair curler comprising:

a flexible, rod-shaped housing having an axial length of at least about 7.5 inches and a width of at least about 1.25 inches, the housing having a first flat end portion and a second flat end portion, the first and second flat end portions being attachable to each other, the housing including a fire-retardant material;

a center body portion located between the first and second flat end portions of the housing and being formed from the fire-retardant material, the center body portion having a first end bounded from the first flat end portion by a first seam and a second end bounded from the second flat end portion by a second seam; and silica beads having diameters of about 0.05 millimeters filling the center body portion from the first end to the second end, the silica beads being retained in the center portion by the first and the second seams, wherein the silica beads absorb moisture at a first temperature and expel moisture when heated to a second, higher temperature.

20. The hair curler of claim 19, wherein the heat absorbent material absorbs moisture at room temperature and expels moisture when heated to a temperature above room temperature.

21. The hair curler of claim 19, wherein the elongate casing is formed of a material capable of withstanding temperatures of at least about 250° F.

* * * * *

UNITED STATES PATENT AND TRADEMARK OFFICE

CERTIFICATE OF CORRECTION

PATENT NO. : 7,806,124 B2
APPLICATION NO. : 11/221224
DATED : October 5, 2010
INVENTOR(S) : Vivienne J. Mackinder It is certified that error appears in the above-identified patent and that said Letters Patent is hereby corrected as shown below:

Col. 6, Line 46
Delete "silicia"
Insert --silica--

Signed and Sealed this
Eighteenth Day of October, 2011

David J. Kappos

David J. Kappos
*Director of the United States Patent and Trademark Office*